US011270651B2

(12) United States Patent
Zhang et al.

(10) Patent No.: US 11,270,651 B2
(45) Date of Patent: Mar. 8, 2022

(54) DISPLAY PANEL AND DISPLAY TERMINAL

(71) Applicant: SHENZHEN CHINA STAR OPTOELECTRONICS SEMICONDUCTOR DISPLAY TECHNOLOGY CO., LTD., Shenzhen (CN)

(72) Inventors: Liuqi Zhang, Shenzhen (CN); Baixiang Han, Shenzhen (CN)

( * ) Notice: Subject to any disclaimer, the term of this patent is extended or adjusted under 35 U.S.C. 154(b) by 271 days.

(21) Appl. No.: 16/639,758

(22) PCT Filed: Dec. 27, 2019

(86) PCT No.: PCT/CN2019/129251

§ 371 (c)(1),
(2) Date: Feb. 18, 2020

(87) PCT Pub. No.: WO2021/120312

PCT Pub. Date: Jun. 24, 2021

(65) Prior Publication Data

US 2021/0398492 A1 Dec. 23, 2021

(30) Foreign Application Priority Data

Dec. 16, 2019 (CN) ..... 201911291770.5

(51) Int. Cl.

| | |
|---|---|
| ***G09G 3/32*** | (2016.01) |
| ***G09G 3/3275*** | (2016.01) |
| ***G09G 3/3266*** | (2016.01) |
| *G09G 3/3291* | (2016.01) |

(52) U.S. Cl.

CPC ..... *G09G 3/3275* (2013.01); *G09G 3/3266* (2013.01); *G09G 3/3291* (2013.01); *G09G 2320/0238* (2013.01); *G09G 2320/0295* (2013.01)

(58) Field of Classification Search

CPC ..... G09G 3/3233; G09G 3/3275; G09G 2320/0295; G09G 3/3291; G09G 2300/0842; G09G 3/3258; G09G 3/3208; G09G 3/3225; G09G 2300/0809; G09G 2300/0408

See application file for complete search history.

(56) References Cited

U.S. PATENT DOCUMENTS

| | | | | |
|---|---|---|---|---|
| 9,129,923 | B1 * | 9/2015 | Han | H01L 27/3262 |
| 10,777,141 | B2 * | 9/2020 | Jeong | G02F 1/1343 |
| 2016/0125811 | A1 * | 5/2016 | Park | G09G 3/3258 345/694 |
| 2016/0148578 | A1 * | 5/2016 | Kishi | G09G 3/3291 345/212 |
| 2016/0225312 | A1 * | 8/2016 | Byun | G09G 3/006 |
| 2018/0005571 | A1 * | 1/2018 | Song | G09G 3/3208 |
| 2019/0206971 | A1 * | 7/2019 | Kim | H01L 27/3272 |

(Continued)

*Primary Examiner* — Michael J Eurice

(57) ABSTRACT

A display panel and a display terminal are provided. The display panel includes a base substrate and a plurality of sub-pixels. The sub-pixels include a sub-pixel driving circuit and a light emitting device. The sub-pixel driving circuit includes a detection unit, a first light emitting control unit, and a second light emitting control unit. By detecting a potential of a second node, the light emitting device does not emit light abnormally, there is no need to perform dark line processing on the sub-pixels in a current row, and influence of dark lines is eliminated.

20 Claims, 4 Drawing Sheets

(56) References Cited

U.S. PATENT DOCUMENTS

| | | | | |
|---|---|---|---|---|
| 2019/0206972 | A1* | 7/2019 | Park | H01L 27/3265 |
| 2019/0266949 | A1* | 8/2019 | Chen | H01L 27/1225 |
| 2019/0355302 | A1* | 11/2019 | Ding | H01L 27/14609 |
| 2020/0051496 | A1* | 2/2020 | Kang | G09G 3/3266 |

* cited by examiner

DISPLAY PANEL AND DISPLAY TERMINAL

FIELD OF INVENTION

The present disclosure relates to the field of display technologies, and more particularly to a display panel and a display terminal.

BACKGROUND OF INVENTION

Organic light emitting diode (OLEDs) are self-luminous display technologies, which have advantages of wide viewing angles, high contrast, low power consumption, and vivid colors, etc. Due to these advantages, a proportion of active matrix organic light emitting diodes (AMOLEDs) in the display industry is gradually increasing.

Technical Problem

As a display panel is used for a longer period, electrical properties of thin film transistors in the display panel will drift. Therefore, various compensation schemes are usually introduced in a pixel driving circuit design. During an external compensation of a threshold voltage of a driving thin film transistor, it is usually necessary to detect a voltage of a source of the driving thin film transistor. In order to ensure that pixels in a row do not affect display of a panel, separate signal traces are designed for a power low-voltage signal of each sub-pixel. Therefore, during a detection process, a voltage of the power low-voltage signal corresponding to the current row of the sub-pixels is raised. This makes a potential of a cathode of the organic light emitting diode higher than that of an anode, and thus does not emit light, and is treated as dark lines. Although this design can compensate the threshold voltage of the driving thin film transistor, configuring an independent low-voltage signal trace for each sub-pixel will not only increase complexity of the pixel driving circuit, but also increase difficulty of the process. At the same time, processing the sub-pixels in the row as dark lines will also affect a display performance of the display panel.

In summary, the existing display panel has an issue that when a sub-pixel driving circuit performs threshold voltage detection, a row of sub-pixels is treated as dark lines to affect a display performance of the display panel. Therefore, it is necessary to provide a display panel and a display terminal to improve this defect.

SUMMARY OF INVENTION

Embodiments of the present disclosure provide a display panel and a display terminal, which are used to solve an issue that a row of sub-pixels is treated as dark lines to affect a display performance of a display panel when a sub-pixel driving circuit of an existing display panel performs threshold voltage detection.

An embodiment of the present disclosure provides a display panel, comprising a base substrate, a plurality of sub-pixels arranged on the base substrate and arranged in an array, and a data signal line connected to the sub-pixels. The sub-pixels comprise a sub-pixel driving circuit and a light emitting device, the sub-pixel driving circuit comprises a data signal input unit, a storage unit, a driving unit, a detection unit, a first light emitting control unit, and a second light emitting control unit. The data signal input unit is connected to a data signal and a first control signal and is coupled to the driving unit at a first node. The driving unit is connected to a power high-voltage signal and is coupled to the first light emitting control unit and the detection unit at a second node. The first light emitting control unit is connected to a first light emitting control signal and is coupled to the light emitting device and the second light emitting control unit at a third node. The second light emitting control unit is connected to a second light emitting control signal and is electrically connected to a node of a sub-pixel driving circuit of an adjacent row of the sub-pixels connected to a same data signal line.

In an embodiment of the present disclosure, the first light emitting control unit comprises a first thin film transistor, a gate of the first thin film transistor is connected to the first light emitting control signal, a first end of the first thin film transistor is electrically connected to the second node, and a second end of the first thin film transistor is electrically connected to the third node.

In an embodiment of the present disclosure, the second light emitting control unit comprises a second thin film transistor, a gate of the second thin film transistor is connected to a second light emitting control signal, a first end of the second thin film transistor is electrically connected to the third node, and a second end of the second thin film transistor is electrically connected to a node of a sub-pixel driving circuit of an adjacent row of the sub-pixels connected to a same data signal line.

In an embodiment of the present disclosure, a potential of the first light emitting control signal and a potential of the second light emitting control signal are opposite.

In an embodiment of the present disclosure, timing of the sub-pixel driving circuit comprises a reset phase, a threshold voltage storage phase, and a detection phase, the timing of the sub-pixel driving circuit further comprises a black insertion area, the black insertion area partially overlaps the threshold voltage storage phase, and the detection phase is located in the black insertion area.

In an embodiment of the present disclosure, in the reset phase, the first control signal, the second driving signal, and the second light emitting control signal are all at a high potential, and the first light emitting control signal is at a low potential; in the threshold voltage storage phase, the first control signal and the second light emitting control signal are both at the high potential, and the second control signal is at the low potential and changes to the high potential after entering the black insertion area; and in the detection phase, the first control signal, the second control signal, and the second light emitting control signal are all at the high potential.

In an embodiment of the present disclosure, the detection unit comprises a third thin film transistor, the display panel further comprises an external detection unit, a gate of the third thin film transistor is connected to the second control signal, a first end of the third thin film transistor is electrically connected to the second node, and a second end of the third thin film transistor is connected to the external detection unit.

In an embodiment of the present disclosure, the external detection unit comprises a detection signal line, an initialization circuit, and a detection circuit, the detection signal line is coupled to the initialization circuit and the detection circuit at a fourth node, the initialization circuit is connected to an initialization control signal, and the detection circuit is connected to a scan signal.

In an embodiment of the present disclosure, in the initialization phase, the initialization signal is at the high potential and the scan signal is at the low potential; in the threshold voltage storage stage, the initialization signal is at the high potential and changes to the low potential after entering the black insertion area, and the scan signal is at the low potential; and in the detection phase, the initialization signal is at the low potential, and the scan signal is changed from the low potential to the high potential.

An embodiment of the present disclosure further provides a display terminal comprising a display panel. The display panel comprises a base substrate, a plurality of sub-pixels arranged on the base substrate and arranged in an array, and a data signal line connected to the sub-pixels. The sub-pixels comprise a sub-pixel driving circuit and a light emitting device, the sub-pixel driving circuit comprises a data signal input unit, a storage unit, a driving unit, a detection unit, a first light emitting control unit, and a second light emitting control unit. The data signal input unit is connected to a data signal and a first control signal and is coupled to the driving unit at a first node. The driving unit is connected to a power high-voltage signal and is coupled to the first light emitting control unit and the detection unit at a second node. The first light emitting control unit is connected to a first light emitting control signal and is coupled to the light emitting device and the second light emitting control unit at a third node. The second light emitting control unit is connected to a second light emitting control signal and is electrically connected to a node of a sub-pixel driving circuit of an adjacent row of the sub-pixels connected to a same data signal line.

In an embodiment of the present disclosure, the first light emitting control unit comprises a first thin film transistor, a gate of the first thin film transistor is connected to the first light emitting control signal, a first end of the first thin film transistor is electrically connected to the second node, and a second end of the first thin film transistor is electrically connected to the third node.

In an embodiment of the present disclosure, the second light emitting control unit comprises a second thin film transistor, a gate of the second thin film transistor is connected to a second light emitting control signal, a first end of the second thin film transistor is electrically connected to the third node, and a second end of the second thin film transistor is electrically connected to a node of a sub-pixel driving circuit of an adjacent row of the sub-pixels connected to a same data signal line.

In an embodiment of the present disclosure, a potential of the first light emitting control signal and a potential of the second light emitting control signal are opposite.

In an embodiment of the present disclosure, timing of the sub-pixel driving circuit comprises a reset phase, a threshold voltage storage phase, and a detection phase, the timing of the sub-pixel driving circuit further comprises a black insertion area, the black insertion area partially overlaps the threshold voltage storage phase, and the detection phase is located in the black insertion area.

In an embodiment of the present disclosure, in the reset phase, the first control signal, the second driving signal, and the second light emitting control signal are all at a high potential, and the first light emitting control signal is at a low potential; in the threshold voltage storage phase, the first control signal and the second light emitting control signal are both at the high potential, and the second control signal is at the low potential and changes to the high potential after entering the black insertion area; and in the detection phase, the first control signal, the second control signal, and the second light emitting control signal are all at the high potential.

In an embodiment of the present disclosure, the detection unit comprises a third thin film transistor, the display panel further comprises an external detection unit, a gate of the third thin film transistor is connected to the second control signal, a first end of the third thin film transistor is electrically connected to the second node, and a second end of the third thin film transistor is connected to the external detection unit.

In an embodiment of the present disclosure, the external detection unit comprises a detection signal line, an initialization circuit, and a detection circuit, the detection signal line is coupled to the initialization circuit and the detection circuit at a fourth node, the initialization circuit is connected to an initialization control signal, and the detection circuit is connected to a scan signal.

In an embodiment of the present disclosure, in the initialization phase, the initialization signal is at the high potential and the scan signal is at the low potential; in the threshold voltage storage stage, the initialization signal is at the high potential and changes to the low potential after entering the black insertion area, and the scan signal is at the low potential; and in the detection phase, the initialization signal is at the low potential, and the scan signal is changed from the low potential to the high potential.

An embodiment of the present disclosure further provides a display terminal comprising a display panel. The display panel comprises a base substrate, a plurality of sub-pixels arranged on the base substrate and arranged in an array, and a data signal line connected to the sub-pixels. The sub-pixels comprise a sub-pixel driving circuit and a light emitting device, the sub-pixel driving circuit comprises a data signal input unit, a storage unit, a driving unit, a detection unit, a first light emitting control unit, and a second light emitting control unit. The data signal input unit is connected to a data signal and a first control signal and is coupled to the driving unit at a first node. The driving unit is connected to a power high-voltage signal and is coupled to the first light emitting control unit and the detection unit at a second node. The first light emitting control unit comprises a first thin film transistor, a gate of the first thin film transistor is connected to the first light emitting control signal, a first end of the first thin film transistor is electrically connected to the second node. The second light emitting control unit comprises a second thin film transistor, a gate of the second thin film transistor is connected to a second light emitting control signal, a first end of the second thin film transistor, a second end of the first thin film transistor, and the light emitting device are coupled to a third node, and a second end of the second thin film transistor is electrically connected to a node of a sub-pixel driving circuit of an adjacent row of the sub-pixels connected to a same data signal line.

In an embodiment of the present disclosure, a potential of the first light emitting control signal and a potential of the second light emitting control signal are opposite.

Beneficial Effect

A beneficial effect of an embodiment of the present disclosure: The embodiment of the present disclosure adds the first light emitting control unit between the light emitting device and the second node in the sub-pixel driving circuit of the display panel. When the potential of the second node is detected, the first light emitting control unit is controlled to be turned off by the first light emitting control signal. This prevents the light emitting device from abnormally emitting light due to the potential rise of the second node. Therefore, there is no need to set a separate low-voltage signal trace for a power supply for each sub-pixel driving circuit. In addition, the second light emitting control unit is added between the third node and the node of the sub-pixel driving circuit of an adjacent row of sub-pixels connected to the same data signal line. The light emitting device in the current row is connected in parallel with the light emitting device in the adjacent row of sub-pixels. When the potential of the second node is detected, the light emitting device in the current row emits light with the same brightness as the light emitting device in the adjacent row. This eliminates the need to perform dark line processing on the current row of sub-pixels, eliminates effects of dark lines, and improves a display performance of the display panel.

DESCRIPTION OF DRAWINGS

In order to explain the technical solutions in the embodiments of the present application more clearly, the drawings used in the description of the embodiments will be briefly introduced below. Obviously, the drawings in the following description are only some embodiments of the present application. For those skilled in the art, other drawings can be obtained based on these drawings without paying creative efforts.

DETAILED DESCRIPTION OF PREFERRED EMBODIMENTS

Figure 1:
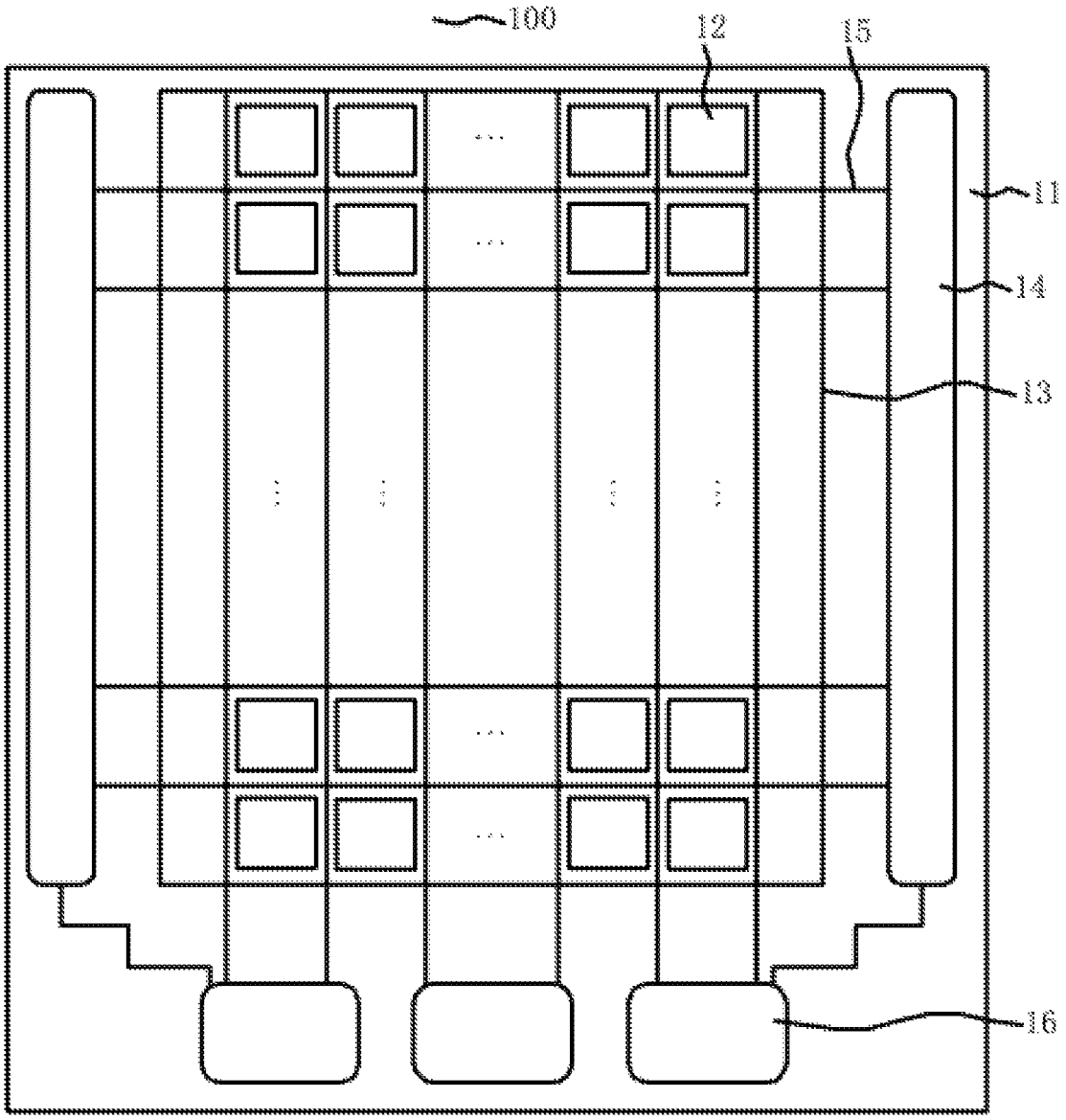
FIG. 1 is a schematic plan view of a display panel according to an embodiment of the present disclosure.

The following descriptions of the embodiments are with reference to the attached drawings, which are used to illustrate specific embodiments that can be implemented by the present application. The directional terms mentioned in this application, such as "up", "down", "front", "rear", "left", "right", "inside", "outside", "side", etc., are only directions with reference to attached drawings. Therefore, the directional terms used are used to explain and understand the present application, not to limit the present application. In the figures, similarly structured units are denoted by the same reference numerals.

Figure 2:
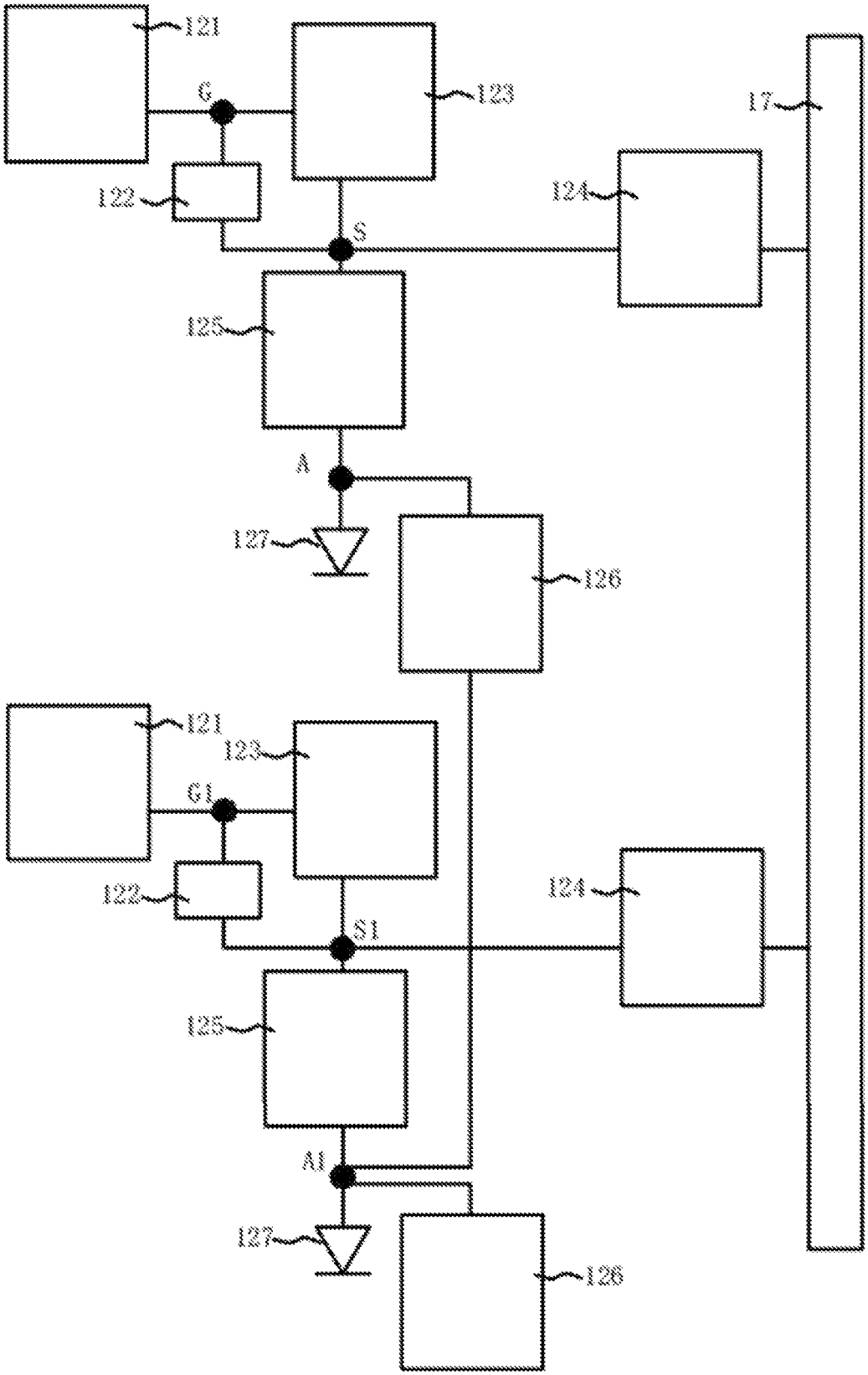
FIG. 2 is a schematic structural diagram of a sub-pixel driving circuit according to an embodiment of the present disclosure.

The disclosure is further described below with reference to the drawings and specific embodiments:

An embodiment of the present disclosure provides a display panel, which will be described in detail below with reference to FIG. 1 to FIG. 3. As shown in FIG. 1, FIG. 1 is a schematic plan view of a display panel 100 according to an embodiment of the present disclosure. The display panel includes a base substrate 11, a plurality of sub-pixels 12 arranged on the base substrate 11 and arranged in an array, and a gate driver on array (GOA) circuit unit 14 arranged on a periphery of the plurality of sub-pixels 12 arranged in the array. The GOA circuit unit includes a multi-stage GOA circuit arranged in cascade. Each stage of GOA circuit is connected to a corresponding row of sub-pixels 12 through a scan signal line 14 for providing a scan signal. One end of the GOA circuit unit is connected to a flip-chip film 16 on one side of the display panel 100 through a wire. The display panel 100 further includes a plurality of data signal lines 13. Each of the data signal lines 13 is connected to a corresponding column of the sub-pixels 12 for providing a data signal Data. Another end of the data signal line 13 is also connected to the flip-chip film 16.

The sub-pixels 12 include a sub-pixel driving circuit and a light emitting device. As shown in FIG. 2, FIG. 2 is a schematic structural diagram of a sub-pixel driving circuit according to an embodiment of the present disclosure. The sub-pixel driving circuit includes a data signal input unit 121, a storage unit 122, a driving unit 123, a detection unit 124, a first light emitting control unit 125, and a second light emitting control unit 126. The data signal input unit is connected to the data signal Data and is coupled to a first node G with the driving unit 123 and the storage unit. The driving unit 123 is connected to a power high-voltage signal VDD and is coupled to a second node S with the storage unit 122, the detection unit 124, and the first light emitting control unit 125. The detection unit 124 of each column of the sub-pixel driving circuit is connected to the same external detection unit 17 of the display panel 100. The first light emitting control unit 125 is connected to a first light emitting control signal EM and is coupled to a third node A with the light emitting device 127 and the second light emitting control unit 126. The second light emitting control unit 126 is connected to the second light emitting control signal XEM and is electrically connected to a node A1 of the sub-pixel driving circuit of the adjacent row of sub-pixels 12 connected to the same data signal line 13.

In an embodiment of the present disclosure, the sub-pixels arranged in a first row and a second row on the display panel 100 are taken as an example for illustration. As shown in FIG. 3, FIG. 3 is a schematic structural diagram of a sub-pixel driving circuit according to an embodiment of the present disclosure. In the sub-pixel driving circuit located in the first row, the first light emitting control unit 125 includes a first thin film transistor T11. A gate of the first thin film transistor T11 is connected to the first light emitting control signal EM in the first row. A first end of the first thin film transistor T11 is electrically connected to the second node S, and a second end thereof is electrically connected to the third node A. The second light emitting control unit 126 includes a second thin film transistor T12. A gate of the second thin film transistor T12 is connected to a second light emitting control signal XEM. A first end of the second thin film transistor T12 is electrically connected to the third node A, and a second end thereof is electrically connected to a node A1 of a sub-pixel driving circuit of an adjacent row of sub-pixels connected to the same data signal line 13. This makes the light emitting devices 127 of two adjacent rows of the sub-pixels 12 in parallel.

Figure 3:
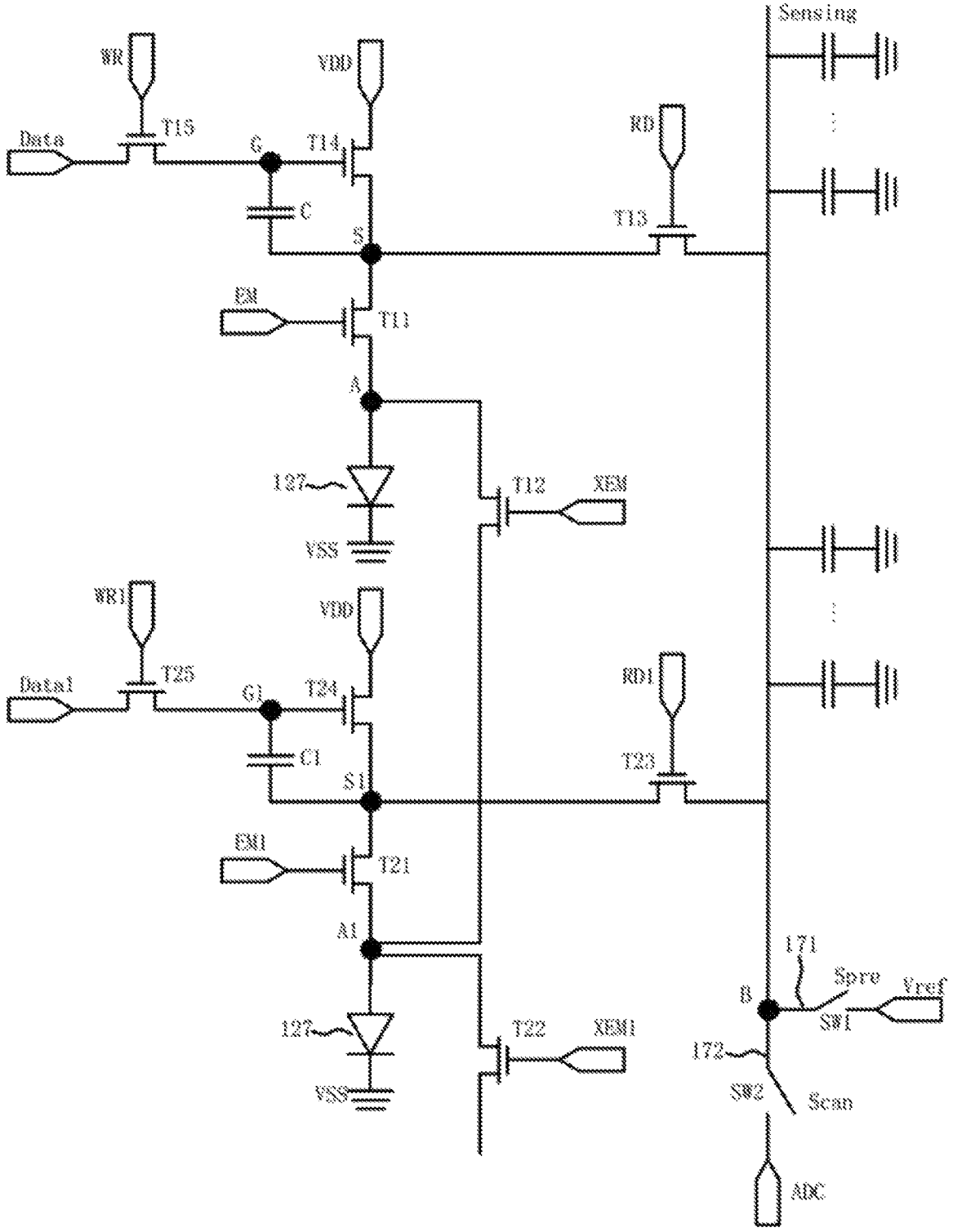
FIG. 3 is a schematic structural diagram of a sub-pixel driving circuit according to an embodiment of the present disclosure.

As shown in FIG. 3, the data signal input unit 121 includes a fifth thin film transistor T15. A gate of the fifth thin film transistor T15 is connected to a first control signal WR. A first end of the fifth thin film transistor T15 is connected to a data signal Data, and a second end thereof is electrically connected to a first node G. The driving unit 123 includes a fourth thin film transistor T14. The fourth thin film transistor T14 is a driving thin film transistor. A gate of the fourth thin film transistor T14 is electrically connected to the first node G. A first end of the fourth thin film transistor T14 is connected to a power high-voltage signal VDD, and a second end thereof is electrically connected to a second node S. The storage unit 122 includes a storage capacitor C. Two ends of the storage capacitor C are electrically connected to the first node G and the second node S, respectively. The detection unit 123 includes a third thin film transistor T13. A gate of the third thin film transistor T13 is connected to a second control signal RD. A first end of the third thin film transistor is electrically connected to the second node S, and a second end thereof is connected to an external detection unit 17.

The external detection unit 17 includes a detection signal line Sensing, an initialization circuit 171, and a detection circuit 172. The detection signal line Sensing is coupled to a fourth node B with the initialization circuit 171 and the detection circuit 172. The initialization circuit 171 is connected to a reference voltage signal Vref, which includes a first switch SW1. The detection circuit 172 includes an analog-to-digital converter ADC and a second switch SW2. The first switch SW1 is connected to an initialization control signal Spre, and the second switch SW2 is connected to a scan signal Scan.

As shown in FIG. 3, the structure of the sub-pixel driving circuit in the second row is the same as the structure of the sub-pixel driving circuit in the first row. A gate of the fifth thin film transistor T25 of the second row of sub-pixel driving circuit is connected to the first control signal WR1 of the current row, the first end thereof is connected to the data signal Data1, and the second end thereof is connected to the gate of the fourth thin film transistor T24. The first end of the storage capacitor C1 is coupled to the first node G1. The first end of the fourth thin film transistor T24 is connected to the power high-voltage signal VDD, and the second end thereof is coupled to the first end of the third thin film transistor T23, the second end of the storage capacitor C1, and the first end of the first thin film transistor T21 at the second node S1. The gate of the third thin film transistor T23 is connected to the second control signal RD1, and the second end thereof is connected to the detection signal line Sensing. The gate of the first thin film transistor T21 is connected to the first light emitting control signal EM1, and the second end thereof is coupled to the light emitting device 127 and the first end of the second thin film transistor T22 at the third node A1. The gate of the second thin film transistor T22 is connected to the second light emitting control signal XEM1, and the second end thereof is electrically connected to a node (not shown in the figure) of the sub-pixel driving circuit in the next row.

In an embodiment of the present disclosure, potentials of the first light emitting control signal EM and the second light emitting control signal XEM are opposite.

Figure 4:
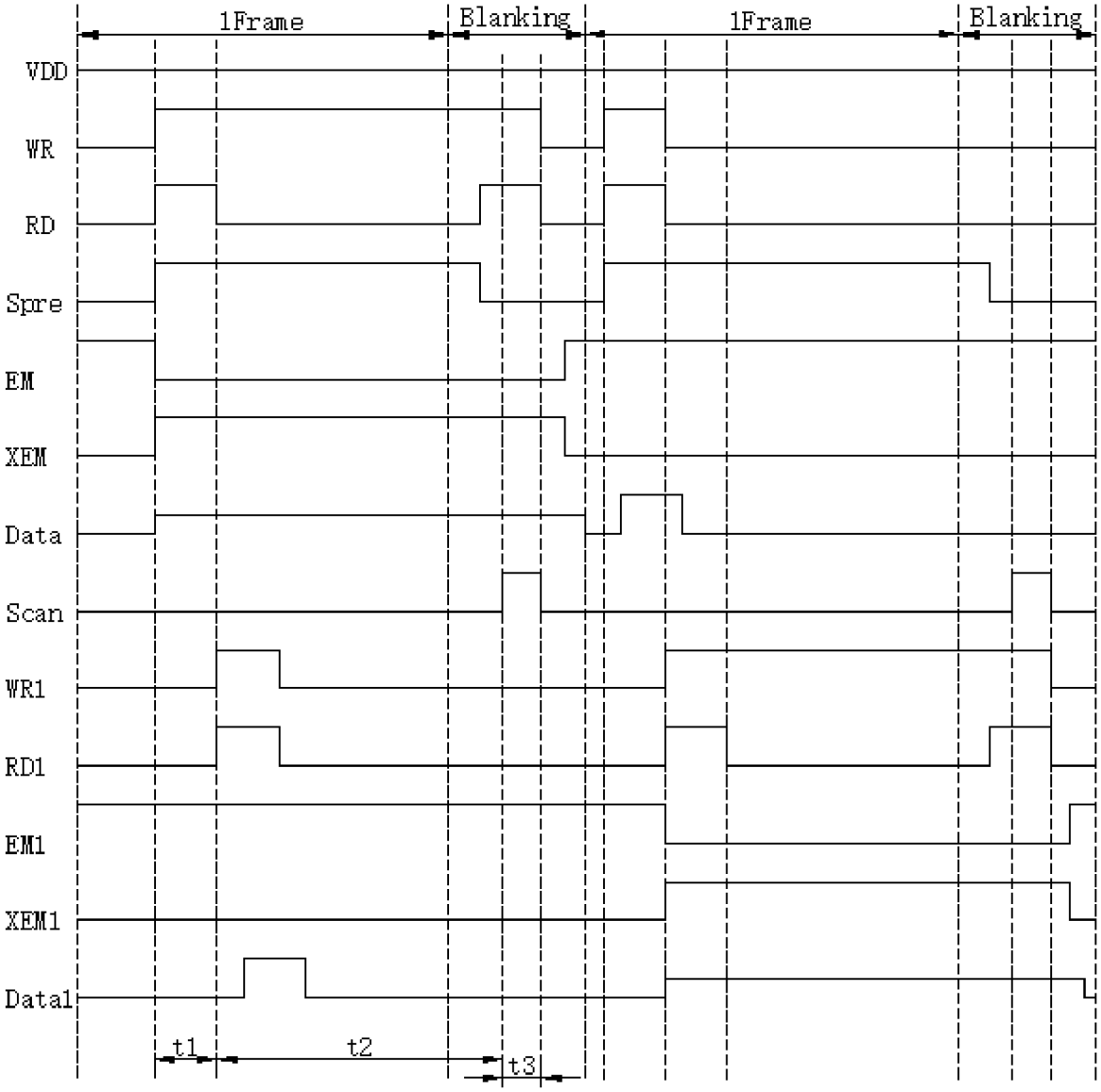
FIG. 4 is a timing diagram of a sub-pixel driving circuit according to an embodiment of the present disclosure.

Specifically, as shown in FIG. 4, FIG. 4 is a timing diagram of a sub-pixel driving circuit according to an embodiment of the present disclosure. Timing of the sub-pixel driving circuit includes a reset phase t1, a threshold voltage storage phase t2, and a detection phase t3. The timing of the sub-pixel driving circuit further includes a blanking area Blanking. The black insertion area Blanking is located between two adjacent frames in the timing of the sub-pixel driving circuit. The black insertion area Blanking partially overlaps the threshold voltage storage stage t2. The detection phase t3 is located in the black insertion area Blanking.

Take first and second rows of sub-pixel driving circuits shown in FIG. 3 as an example. At a current 1 frame (1 Frame), the first row of sub-pixels ends emitting light, and enters a reset phase t1, and a first emitting control signal EM of the first row of sub-pixels changes from a high potential to a low potential. A second light emitting control signal XEM is changed from a low potential to a high potential. A first control signal WR, the second control signal RD, and a initialization control signal Spre are all changed from a low potential to a high potential. A corresponding first thin film transistor T11 is turned off. A second thin film transistor T12, a third thin film transistor T13, a fifth thin film transistor T15, and a first switch SW1 are all turned on. A data signal Data inputs an initial potential to a first node G through a fifth thin film transistor T15. The initialization circuit inputs a reference voltage signal Vref to a second node S, thereby resetting potentials of the first node G and the second node S.

In a threshold voltage storage phase t2, the first control signal WR maintains a high potential, and the second control signal RD changes from a high potential to a low potential. The corresponding fifth thin film transistor T15 remains on, and the third thin film transistor T13 is turned off. The data signal Data charges the first node through the fifth thin film transistor T15. The power high-voltage signal VDD charges the second node S through the fourth thin film transistor T14. The potential of the second node S is continuously increased until the difference between the potential VG of the first node G and the potential VS of the second node is the threshold voltage Vth of the fourth thin film transistor T14. At this time, the timing of the pixel driving circuit enters the black insertion area Blanking. The threshold voltage Vth of the fourth thin film transistor T14 is stored in the storage capacitor C. In this phase, in the sub-pixel driving circuit of the remaining rows of sub-pixels 12 in the display panel 100, the data signal Data can be kept normally written.

In the threshold voltage storage phase t2, the first light emitting control signal EM is at a low potential, and the second light emitting control signal XEM is maintained at a high potential. This turns off the first thin film transistor T11 and turns on the second thin film transistor T12. The light emitting device 127 does not emit light abnormally due to the rise in the potential of the second node S. In the sub-pixel driving circuit in the second row, the first light emitting control signal EM1 is at a high potential at this time. The first thin film transistor T21 of the sub-pixel driving circuit in the second row is turned on, and the light emitting device 127 emits light. The second thin film transistor T12 located in the first row of sub-pixels is also turned on at this time. This makes the light-emitting device 127 of the sub-pixels in the first row and the light-emitting device 127 of the second-row sub-pixels in parallel, and both emit light of the same brightness. Therefore, it is not necessary to process the sub-pixels displayed at the end of the current line as dark lines. This can not only improve the display performance of the display panel 100, but also does not need to separately set a signal trace of the power low-voltage signal VSS. This enables power low-voltage signal traces to maintain the entire design, while optimizing the sub-pixel driving circuit structure, it can also reduce a corresponding production process and improve production efficiency.

In the threshold voltage storage phase t2, the initialization control signal Spre is maintained at a high potential until all signals of the sub-pixel driving circuits of all rows of the same data signal line 13 are written. That is, entering the black insertion area Blanking is performed. At this time, the initialization control signal Spre changes to a low potential.

In the detection phase, the first control signal WR, the second control signal RD, the second light emitting control signal XEM, and a scan signal Scan of the first row of sub-pixel driving circuits are all at a high potential. The first light emitting control signal EM and the initialization control signal Spre are at a low potential. The corresponding first thin film transistor T11 is turned off. The second thin film transistor T12, the third thin film transistor T13, and the fifth thin film transistor T15 are all turned on. The first switch SW1 is turned off, and the second switch SW2 is turned on. A analog-to-digital converter ADC on the detection circuit detects the potential of the second node S through the third thin film transistor T13, and calculates the threshold voltage Vth of the fourth thin film transistor T14 in the current row to complete the fourth thin film transistor of the driving unit 123. Detection of threshold voltage Vth of T14 is performed. After entering the next frame, the first control signal WR and the second control signal RD change to a high potential. The corresponding fifth thin film transistor T15 and the third thin film transistor T13 are turned on. The potential of the data signal Data is increased by external compensation, and then the data signal Data is input to the first node G through the fifth thin film transistor T5. This increases the potential of the first node G, increases the current flowing through the second node S, and implements current compensation in the first row of sub-pixel driving circuits. Thereby, the influence of the threshold voltage Vth of the fourth thin film transistor T14 is canceled, and uniform light emission brightness of the light emitting device 127 is ensured.

In an embodiment of the present disclosure, the light emitting device 127 is an organic light emitting diode (OLED). The driving method adopted by the sub-pixel driving circuit is an active matrix driving method. Of course, in some embodiments, the light emitting device 127 may also be a micro light emitting diode (Micro LED), which can achieve the same technical effects as the embodiments of the present disclosure, which is not limited here.

A beneficial effect of an embodiment of the present disclosure: The embodiment of the present disclosure adds the first light emitting control unit between the light emitting device and the second node in the sub-pixel driving circuit of the display panel. When the potential of the second node is detected, the first light emitting control unit is controlled to be turned off by the first light emitting control signal. This prevents the light emitting device from abnormally emitting light due to the potential rise of the second node. Therefore, there is no need to set a separate low-voltage signal trace for a power supply for each sub-pixel driving circuit. In addition, the second light emitting control unit is added between the third node and the node of the sub-pixel driving circuit of an adjacent row of sub-pixels connected to the same data signal line. The light emitting device in the current row is connected in parallel with the light emitting device in the adjacent row of sub-pixels. When the potential of the second node is detected, the light emitting device in the current row emits light with the same brightness as the light emitting device in the adjacent row. This eliminates the need to perform dark line processing on the current row of sub-pixels, eliminates effects of dark lines, and improves a display performance of the display panel.

An embodiment of the present disclosure further provides a display terminal, which includes the display panel provided by the foregoing embodiment and can achieve the same technical effects as the display panel provided by the foregoing embodiment, which will not be repeated here.

In summary, although the present disclosure is disclosed as above with preferred embodiments, the above preferred embodiments are not intended to limit the present disclosure. Those of ordinary skill in the art can make various modifications and decorations without departing from the spirit and scope of the present disclosure. Therefore, the protection scope of the present disclosure is based on the scope defined by the claims.

What is claimed is:

1. A display panel, comprising:

a base substrate, a plurality of sub-pixels arranged on the base substrate and arranged in an array, and a data signal line connected to the sub-pixels, wherein the sub-pixels comprise a sub-pixel driving circuit and a light emitting device, the sub-pixel driving circuit comprises a data signal input unit, a storage unit, a driving unit, a detection unit, a first light emitting control unit, and a second light emitting control unit;

wherein the data signal input unit is connected to a data signal and a first control signal, and is coupled to the driving unit at a first node;

wherein the driving unit is connected to a power high-voltage signal, and is coupled to the first light emitting control unit and the detection unit at a second node;

wherein the first light emitting control unit is connected to a first light emitting control signal, and is coupled to the light emitting device and the second light emitting control unit at a third node; and wherein the second light emitting control unit is connected to a second light emitting control signal and is electrically connected to a node of a sub-pixel driving circuit of an adjacent row of the sub-pixels connected to a same data signal line.

2. The display panel according to claim 1, wherein the first light emitting control unit comprises a first thin film transistor, a gate of the first thin film transistor is connected to the first light emitting control signal, a first end of the first thin film transistor is electrically connected to the second node, and a second end of the first thin film transistor is electrically connected to the third node.

3. The display panel according to claim 2, wherein the second light emitting control unit comprises a second thin film transistor, a gate of the second thin film transistor is connected to a second light emitting control signal, a first end of the second thin film transistor is electrically connected to the third node, and a second end of the second thin film transistor is electrically connected to a node of a sub-pixel driving circuit of an adjacent row of the sub-pixels connected to a same data signal line.

4. The display panel according to claim 3, wherein a potential of the first light emitting control signal and a potential of the second light emitting control signal are opposite.

5. The display panel according to claim 4, wherein timing of the sub-pixel driving circuit comprises a reset phase, a threshold voltage storage phase, and a detection phase, the timing of the sub-pixel driving circuit further comprises a black insertion area, the black insertion area partially overlaps the threshold voltage storage phase, and the detection phase is located in the black insertion area.

6. The display panel according to claim 5, wherein in the reset phase, the first control signal, the second driving signal, and the second light emitting control signal are all at a high potential, and the first light emitting control signal is at a low potential;

in the threshold voltage storage phase, the first control signal and the second light emitting control signal are both at the high potential, and the second control signal is at the low potential and changes to the high potential after entering the black insertion area; and in the detection phase, the first control signal, the second control signal, and the second light emitting control signal are all at the high potential.

7. The display panel according to claim 6, wherein the detection unit comprises a third thin film transistor, the display panel further comprises an external detection unit, a gate of the third thin film transistor is connected to the second control signal, a first end of the third thin film transistor is electrically connected to the second node, and a second end of the third thin film transistor is connected to the external detection unit.

8. The display panel according to claim 7, wherein the external detection unit comprises a detection signal line, an initialization circuit, and a detection circuit, the detection signal line is coupled to the initialization circuit and the detection circuit at a fourth node, the initialization circuit is connected to an initialization control signal, and the detection circuit is connected to a scan signal.

9. The display panel according to claim 8, wherein in the initialization phase, the initialization signal is at the high potential and the scan signal is at the low potential;

in the threshold voltage storage stage, the initialization signal is at the high potential and changes to the low potential after entering the black insertion area, and the scan signal is at the low potential; and in the detection phase, the initialization signal is at the low potential, and the scan signal is changed from the low potential to the high potential.

10. A display terminal comprising a display panel, the display panel comprising:

a base substrate, a plurality of sub-pixels arranged on the base substrate and arranged in an array, and a data signal line connected to the sub-pixels, wherein the sub-pixels comprise a sub-pixel driving circuit and a light emitting device, the sub-pixel driving circuit comprises a data signal input unit, a storage unit, a driving unit, a detection unit, a first light emitting control unit, and a second light emitting control unit;

wherein the data signal input unit is connected to a data signal and a first control signal, and is coupled to the driving unit at a first node;

wherein the driving unit is connected to a power high-voltage signal, and is coupled to the first light emitting control unit and the detection unit at a second node;

wherein the first light emitting control unit is connected to a first light emitting control signal, and is coupled to the light emitting device and the second light emitting control unit at a third node; and wherein the second light emitting control unit is connected to a second light emitting control signal and is electrically connected to a node of a sub-pixel driving circuit of an adjacent row of the sub-pixels connected to a same data signal line.

11. The display terminal according to claim 10, wherein the first light emitting control unit comprises a first thin film transistor, a gate of the first thin film transistor is connected to the first light emitting control signal, a first end of the first thin film transistor is electrically connected to the second node, and a second end of the first thin film transistor is electrically connected to the third node.

12. The display terminal according to claim 11, wherein the second light emitting control unit comprises a second thin film transistor, a gate of the second thin film transistor is connected to a second light emitting control signal, a first end of the second thin film transistor is electrically connected to the third node, and a second end of the second thin film transistor is electrically connected to a node of a sub-pixel driving circuit of an adjacent row of the sub-pixels connected to a same data signal line.

13. The display terminal according to claim 12, wherein a potential of the first light emitting control signal and a potential of the second light emitting control signal are opposite.

14. The display terminal according to claim 13, wherein timing of the sub-pixel driving circuit comprises a reset phase, a threshold voltage storage phase, and a detection phase, the timing of the sub-pixel driving circuit further comprises a black insertion area, the black insertion area partially overlaps the threshold voltage storage phase, and the detection phase is located in the black insertion area.

15. The display terminal according to claim 14, wherein in the reset phase, the first control signal, the second driving signal, and the second light emitting control signal are all at a high potential, and the first light emitting control signal is at a low potential;

in the threshold voltage storage phase, the first control signal and the second light emitting control signal are both at the high potential, and the second control signal is at the low potential and changes to the high potential after entering the black insertion area; and in the detection phase, the first control signal, the second control signal, and the second light emitting control signal are all at the high potential.

16. The display terminal according to claim 15, wherein the detection unit comprises a third thin film transistor, the display panel further comprises an external detection unit, a gate of the third thin film transistor is connected to the second control signal, a first end of the third thin film transistor is electrically connected to the second node, and a second end of the third thin film transistor is connected to the external detection unit.

17. The display terminal according to claim 16, wherein the external detection unit comprises a detection signal line, an initialization circuit, and a detection circuit, the detection signal line is coupled to the initialization circuit and the detection circuit at a fourth node, the initialization circuit is connected to an initialization control signal, and the detection circuit is connected to a scan signal.

18. The display terminal according to claim 17, wherein in the initialization phase, the initialization signal is at the high potential and the scan signal is at the low potential;

in the threshold voltage storage stage, the initialization signal is at the high potential and changes to the low potential after entering the black insertion area, and the scan signal is at the low potential; and in the detection phase, the initialization signal is at the low potential, and the scan signal is changed from the low potential to the high potential.

19. A display terminal comprising a display panel, the display panel comprising:

a base substrate, a plurality of sub-pixels arranged on the base substrate and arranged in an array, and a data signal line connected to the sub-pixels, wherein the sub-pixels comprise a sub-pixel driving circuit and a light emitting device, the sub-pixel driving circuit comprises a data signal input unit, a storage unit, a driving unit, a detection unit, a first light emitting control unit, and a second light emitting control unit;

wherein the data signal input unit is connected to a data signal and a first control signal, and is coupled to the driving unit at a first node;

wherein the driving unit is connected to a power high-voltage signal, and is coupled to the first light emitting control unit and the detection unit at a second node;

wherein the first light emitting control unit comprises a first thin film transistor, a gate of the first thin film transistor is connected to the first light emitting control signal, a first end of the first thin film transistor is electrically connected to the second node; and wherein the second light emitting control unit comprises a second thin film transistor, a gate of the second thin film transistor is connected to a second light emitting control signal, a first end of the second thin film transistor, a second end of the first thin film transistor, and the light emitting device are coupled to a third node, and a second end of the second thin film transistor is electrically connected to a node of a sub-pixel driving circuit of an adjacent row of the sub-pixels connected to a same data signal line.

20. The display terminal according to claim 19, wherein a potential of the first light emitting control signal and a potential of the second light emitting control signal are opposite.

* * * * *